US011351797B2

(12) United States Patent
Noda et al.

(10) Patent No.: US 11,351,797 B2
(45) Date of Patent: Jun. 7, 2022

(54) ULTRAVIOLET RAY IRRADIATING APPARATUS AND IMAGE RECORDING APPARATUS PROVIDED WITH THE SAME

(71) Applicant: BROTHER KOGYO KABUSHIKI KAISHA, Nagoya (JP)

(72) Inventors: Masahiro Noda, Ogaki (JP); Atsushi Ito, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 17/199,673

(22) Filed: Mar. 12, 2021

(65) Prior Publication Data

US 2021/0291565 A1 Sep. 23, 2021

(30) Foreign Application Priority Data

Mar. 17, 2020 (JP) ..... JP2020-046592

(51) Int. Cl.
*B41J 11/00* (2006.01)

(52) U.S. Cl.
CPC .... *B41J 11/00214* (2021.01); *B41J 11/00212* (2021.01); *B41J 11/00218* (2021.01)

(58) Field of Classification Search
CPC ..... B41J 11/00214; B41J 11/00212; B41J 11/00218
See application file for complete search history.

(56) References Cited

FOREIGN PATENT DOCUMENTS

JP 2008-288457 A 11/2008

OTHER PUBLICATIONS

Related U.S. Appl. No. 17/199,711, filed Mar. 12, 2021.

*Primary Examiner* — Bradley W Thies
(74) *Attorney, Agent, or Firm* — Scully, Scott, Murphy & Presser, PC

(57) ABSTRACT

There is provided an ultraviolet ray irradiating apparatus configured to cure an ultraviolet-curable ink, the ultraviolet ray irradiating apparatus including a plurality of light emitting chips configured to emit an ultraviolet ray and arranged with a first pitch in main scanning direction and with a second pitch greater than the first pitch in sub scanning direction. The printing object includes a low part in which a distance from an ultraviolet ray irradiation surface becomes to be a large gap and a high part in which the distance from the ultraviolet ray irradiation surface becomes to be a small gap. The ultraviolet ray irradiating apparatus is configured to irradiate the object such that an illuminance, of the ultraviolet ray is not less than a minimum illuminance required for curing, in an area, of the low part, onto which the ink is discharged by a nozzle outermost in the sub scanning direction.

19 Claims, 10 Drawing Sheets

ULTRAVIOLET RAY IRRADIATING APPARATUS AND IMAGE RECORDING APPARATUS PROVIDED WITH THE SAME

CROSS REFERENCE TO RELATED APPLICATION

The present application claims priority from Japanese Patent Application No. 2020-046592, filed on Mar. 17, 2020, the disclosure of which is incorporated herein by reference in its entirety.

BACKGROUND

The present disclosure relates to an ultraviolet ray irradiating apparatus and an image recording apparatus provided with the ultraviolet ray irradiating apparatus.

In the recent years, there is a known ultraviolet ray irradiating apparatus which is used for a printing machine, and which irradiates, with an ultraviolet ray, an ultraviolet-curable ink which is cured by the ultraviolet ray.

SUMMARY

An object of the present disclosure is to provide an ultraviolet ray irradiating apparatus capable of improving the ink curability by suppressing the unevenness in curing of the ink in the part subjected to large gap printing and capable of suppressing the temperature rise in the part, of the printing object, which is subjected to the small gap printing, and to provide an image recording apparatus provided with the ultraviolet ray irradiating apparatus.

According to an aspect of the present disclosure, there is provided an ultraviolet ray irradiating apparatus configured to cure an ultraviolet-curable ink discharged to an object by a discharging head which has a plurality of nozzles and which is configured to move in a main scanning direction, in a state that the ultraviolet ray irradiating apparatus is moved in the main scanning direction, the ultraviolet ray irradiating apparatus including a plurality of light emitting chips configured to emit an ultraviolet ray, the plurality of light emitting chips being arranged side by side with a first pitch in the main scanning direction and being arranged side by side with a second pitch greater than the first pitch in a sub scanning direction orthogonal to the main scanning direction; and a controller, wherein the printing object includes a low part in which a distance from an ultraviolet ray irradiation surface of each of the plurality of light emitting diode chips to the printing object becomes to be a large gap and a high part in which the distance from the ultraviolet ray irradiation surface to the printing object becomes to be a small gap smaller than the large gap; and the ultraviolet ray irradiating apparatus is configured to irradiate the object with the ultraviolet ray such that an illuminance, of the ultraviolet ray emitted by the plurality of light emitting diode chips is not less than a minimum illuminance required for curing the discharged ink, in an area, of the low part, onto which the ink is discharged by a nozzle, of the plurality of nozzles, positioned outermost in the sub scanning direction.

According to another aspect of the present disclosure, there is provided an ultraviolet ray irradiating apparatus configured to cure an ultraviolet-curable ink discharged to an object, by a discharging head which has a plurality of nozzles and which is configured to move in a main scanning direction, in a state that the ultraviolet ray irradiating apparatus is moved in the main scanning direction, the ultraviolet ray irradiating apparatus comprising a plurality of light emitting chips configured to emit an ultraviolet ray, the plurality of light emitting chips being arranged side by side with a first pitch in the main scanning direction and being arranged side by side with a second pitch greater than the first pitch in a sub scanning direction orthogonal to the main scanning direction, wherein the object includes a low part in which a distance from an ultraviolet ray irradiation surface of each of the plurality of light emitting chips to the object becomes to be a large gap and a high part in which the distance from the ultraviolet ray irradiation surface to the object becomes to be a small gap smaller than the large gap; and the ultraviolet ray irradiating apparatus is configured to irradiate the object with the ultraviolet ray such that an illuminance, of the ultraviolet ray emitted by the plurality of light emitting chips is not less than a minimum illuminance required for curing the discharged ink, in an area, of the low part, arranged so as to face an outermost light emitting chip, of the plurality of light emitting chips, positioned outermost in the sub-scanning direction.

EMBODIMENTS

Figure 1:
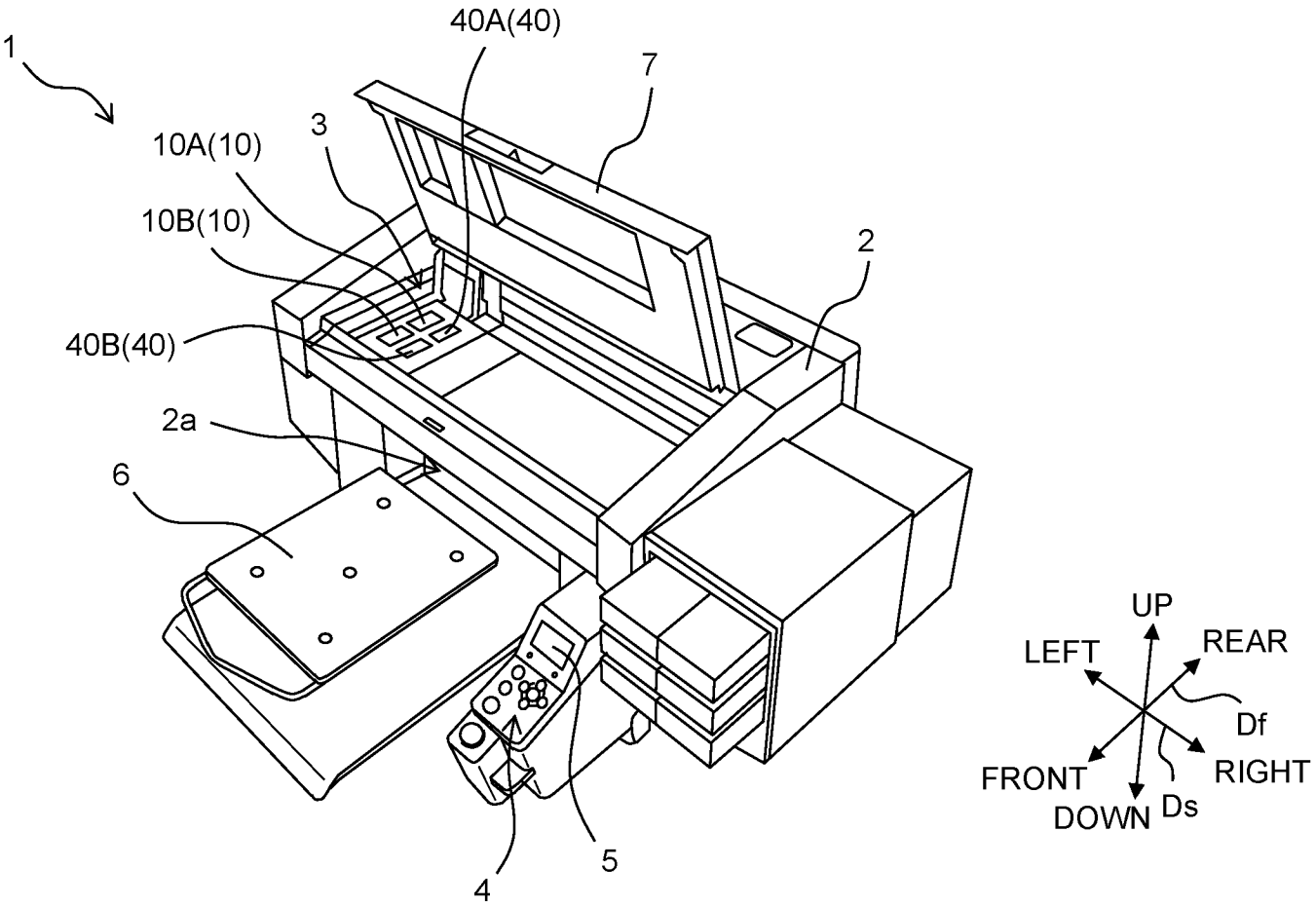
FIG. 1 is a perspective view depicting an image recording apparatus related to an embodiment of the present disclosure.

If the ultraviolet ray irradiating apparatus is used with an ink jet printer, an ink liquid droplet landed on a printing object is irradiated with the ultraviolet ray so that the ultraviolet-curable ink is cured and fixed to the printing object. The use of the ultraviolet-curable ink in this manner enables printing to be performed on, for example, a resin, a metal, etc., other than paper sheet, and a printing object with glossiness can be obtained.

In the ultraviolet ray irradiating apparatus of Japanese Patent Application Laid-open No. 2008-288457, a plurality of light emitting diode chips are provided on a supporting substrate. The plurality of light emitting diode chips is arranged in a matrix shape along the longitudinal direction and the short-length direction of the supporting substrate. An arrangement pitch of the plurality of light-emitting diode chips in the longitudinal direction of the supporting substrate is set to be greater than the arrangement pitch of the plurality of light emitting diode chips in the short-length direction of the supporting substrate. In such a configuration, it is considered that, by continuously irradiating the printing object with the ultraviolet ray while conveying the printing object in a direction in which the arrangement pitch is smaller, a phenomenon of oxygen inhibition that a monomer contained in the ultraviolet-curable ink is bonded to the oxygen is less likely to occur.

Note that in the image recording apparatus including the ultraviolet ray irradiating apparatus, in a case that printing is performed while moving a discharging head and a printing object relative to each other, it is required to perform printing with respect to a printing object having a three-dimensional shape in which a distance from a nozzle of the discharging head to a landing position of the ink droplet on the printing object changes. With respect to the printing object having such a three-dimensional shape, printing by discharging the ink droplet of the ink to a part in which the distance from the nozzle is small (a part to be subjected to a small gap printing) and printing by discharging the ink droplet to a part in which the distance from the nozzle is great (a part to be subjected to a large gap printing) are performed. Thereafter, while the plurality of light emitting diode chips and the printing object are moved relative to each other, the printing object is irradiated with the ultraviolet ray; however, in the part subjected to the small gap printing, a distance from ultraviolet ray irradiation surfaces of the plurality of light emitting diode chips also becomes to be small, and in the part subjected to the large gap printing, the distance from the ultraviolet ray irradiation surfaces of the plurality of light emitting diode chips also becomes to be great. As described above, in a case that there is a difference in height in the printing object, it is difficult to cure the ink in the part subjected to large gap printing, and thus an irradiation condition of the ultraviolet ray is determined based on illuminance of the part to be subjected to large gap printing. However, in the above-described conventional ultraviolet ray irradiating apparatus, although the unevenness in the irradiation light amount in a direction different from the conveyance direction of the printing object is referred to, the part to be subjected to large gap printing is not referred to. For this reason, in the part subjected to large gap printing, the illuminance in an end part in a direction in which the arrangement pitch of the plurality of light emitting diode chips is large becomes low, thereby causing the unevenness in curing of the ink. On the other hand, in a case that the irradiation condition is determined on the basis of the illuminance of the part subjected to large gap printing as described above, the part subjected to the small gap printing might be irradiated with an excessive light amount, and thus there is a need to attempt for suppressing any increase or rise in the temperature in the printing object due to ultraviolet irradiation onto the printing object.

In the following, an ultraviolet ray irradiating apparatus and an image recording apparatus including the same related to the embodiment of the present disclosure will be explained, with reference to the drawings. Each of the ultraviolet ray irradiating apparatus and the image recording apparatus explained below is merely an embodiment of the present invention. Therefore, the present invention is not limited to or restricted by the following embodiment, and any addition, deletion and change can be made with respect to the present disclosure, without departing from the spirit of the present invention.

FIG. 1 is a perspective view depicting an image recording apparatus 1 related to an embodiment of the present disclosure. In FIG. 1, directions which are mutually orthogonal are defined as an up-down direction, a left-right direction and a front-rear direction. Note that the left-right direction is a main scanning direction Ds (to be described later on) and the front-rear direction is a sub scanning direction Df (to be described later on). This image recording apparatus 1 performs not only printing with respect to a printing object (object, print matter) W such as print paper sheet (paper), but also performs, for example, a goods printing of performing printing on a printing object W (FIG. 6) such as a resin, as a variety of kinds of goods. Note that the printing object W may be objects made or shaped by 3D printers.

As depicted in FIG. 1, the image recording apparatus 1 of the present embodiment includes a casing 2, a carriage 3, an operating key 4, a displaying part 5, a platen 6, and an upper cover 7. The image recording apparatus 1 also includes a controller (a control unit) 19 of FIG. 3.

The casing 2 is formed to have a box shape. The casing 2 has an opening 2*a* on a front surface thereof and a non-illustrated opening on a back surface thereof. The operating key 4 is provided on the casing 2 at a location thereof on the right front side. The displaying part 5 is provided at a location on the rear side of the operating key 4. The operating key 4 receives an operation and input by a user. The displaying part 5 is constructed, for example, of a touch panel, and displays predetermined information. A portion of the displaying part 5 also functions as an operating key at a predetermined timing. The controller 19 realizes a printing function and controls displaying of the displaying part 5 based on an input from the operating key 4 or an external input via a non-illustrated communicating interface.

Figure 2:
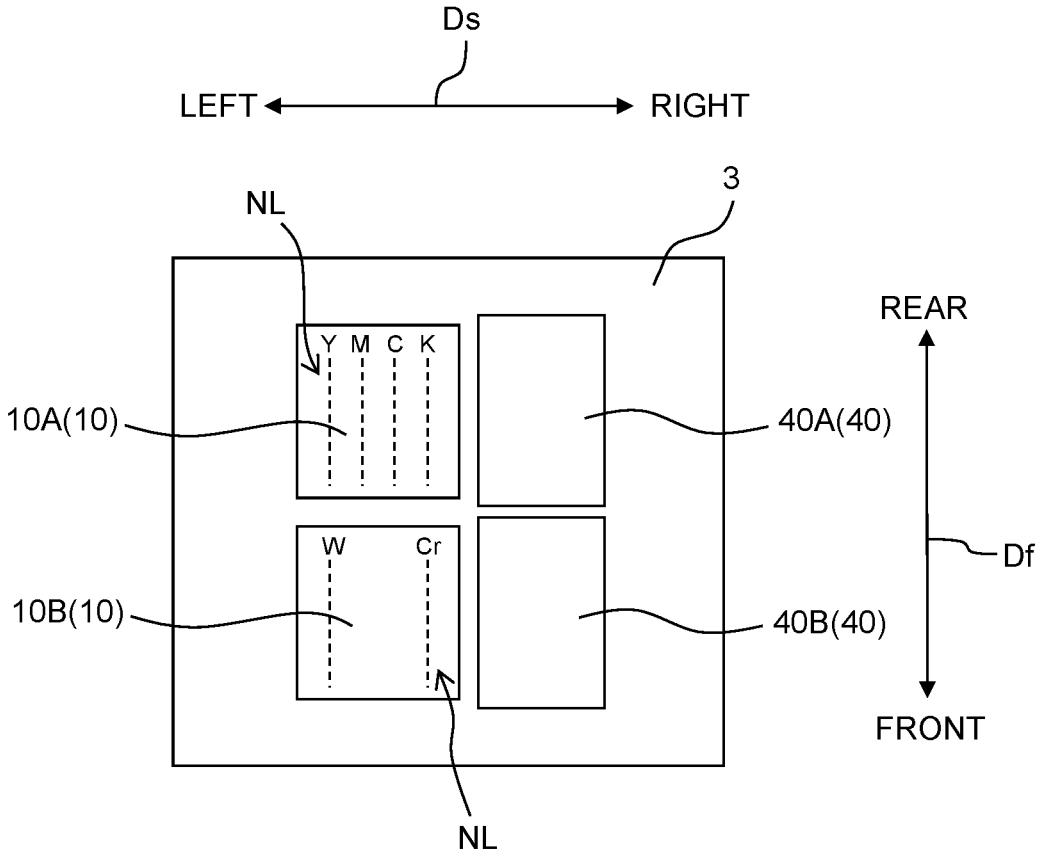
FIG. 2 is a plan view depicting an example of arrangement of a discharging head and an ultraviolet ray irradiating apparatus which are mounted on a carriage of FIG. 1.

The carriage 3 is configured to be reciprocally movable along the main scanning direction Ds. As depicted in FIG. 2, the carriage 3 has two discharging heads 10 (10A, 10B) and two ultraviolet ray irradiating apparatuses 40 (40A, 40B) mounted thereon. As each of the discharging heads 10, it is possible to use, for example, an ink-jet head which discharges or ejects an ultraviolet-curable ink. Further, each of the ultraviolet ray irradiating apparatuses 40 has a plurality of light emitting diode chips (light emitting chips) DT (FIG. 4) which emit an ultraviolet ray, and irradiates the ultraviolet ray for curing the ink discharged by the discharging head(s) 10. The discharging head 10A and the discharging head 10B are arranged side by side along the sub scanning direction Df. The discharging head 10B is located in front of the discharging head 10A. Furthermore, the ultraviolet ray irradiating apparatus 40A and the ultraviolet ray irradiating apparatus 40B are arranged side by side along the sub scanning direction Df. The ultraviolet ray irradiating apparatus 40B is located in front of the ultraviolet ray irradiating apparatus 40A. Moreover, the discharging head 10A and the ultraviolet ray irradiating apparatus 40A are arranged side by side along the main scanning direction Ds. The ultraviolet ray irradiating apparatus 40A is located on the right side with respect to the discharging head 10A. The discharging head 10B and the ultraviolet ray irradiating apparatus 40B are arranged side by side along the main scanning direction Ds. The ultraviolet ray irradiating apparatus 40B is located on the right side with respect to the discharging head 10B.

In FIG. 2, in one pass in a printing processing, the carriage 3 moves to the left side in the main scanning direction Ds.

As a result, the discharging heads 10 and the ultraviolet ray irradiating apparatuses 40 move leftward at the time of the printing processing. In this case, each of the discharging heads 10 discharges the ink to the printing object W while moving to the left side in the main scanning direction Ds, and each of the ultraviolet ray irradiating apparatuses 40 emits the ultraviolet ray to the ink landed on the printing object W while moving to the left side in the main scanning direction Ds. As a result, since the ultraviolet ray irradiating apparatuses 40 are positioned on the rear side with respect to the discharging heads 10 in the moving direction of the carriage 3 at the time of the printing processing, the ink immediately after having landed on the printing object W can be irradiated with the ultraviolet ray.

In a case that one pass of the printing processing is finished, the carriage 3 moves to the right side in the main scanning direction Ds and returns to a predetermined position in the main scanning direction Ds. This moves the discharging heads 10 and the ultraviolet ray irradiating apparatuses 40 to the right side in the main scanning direction Ds. In this case, each of the discharging heads 10 moves to the right side in the main scanning direction Ds without discharging the ink, and each of the ultraviolet ray irradiating apparatuses 40 moves to the right side in the main scanning direction Ds while irradiating the ultraviolet ray to the ink discharged at the time of the printing processing. As a result, the ink can be sufficiently irradiated with the ultraviolet ray, and the curability (hardenability) of the ink can be improved.

In the present embodiment, the discharging head 10A discharges inks of respective colors which are yellow (Y), magenta (M), cyan (C) and black (K), and which may be collectively referred to as a color ink. The discharging head 10A is provided with nozzle arrays (nozzle columns) NL which discharge these inks, respectively, and each of which extends along the sub scanning direction Df. The nozzle arrays NL are provided at a regular spacing distance along the main scanning direction Ds. Note that an arranging order in the main scanning direction Ds of the nozzle arrays NL is not limited to an order, as depicted in FIG. 2, from the left side, of a nozzle array NL discharging the ink of yellow (Y) color, a nozzle array NL discharging the ink of magenta (M) color, a nozzle array NL discharging the ink of cyan (C) color, and a nozzle array NL discharging the ink of black (K) color; and the arranging order may be appropriately set.

On the other hand, the discharging head 10B discharges a white (W) ink and a clear (Cr) ink. The discharging head 10B is provided with nozzle arrays NL discharging the white (W) ink and the clear (Cr) ink, respectively, and extending along the sub scanning direction Df. The nozzle arrays NL are provided at a regular spacing distance along the main scanning direction Ds. The spacing distance in the main scanning direction Ds between the respective nozzle arrays NL in the discharging head 10B may be different from the spacing distance in the main scanning direction Ds between the respective nozzle arrays NL in the discharging head 10A (examples of FIG. 2) or may be the same. Note that the arranging order in the main scanning direction Ds of the respective nozzle arrays NL is not limited to the arranging order, as depicted in FIG. 2, from the left side, of the nozzle array NL discharging the ink of white (W) color and the nozzle array NL discharging the ink of clear (C) color, and may be reversely arranged. The forgoing six color inks are discharged onto the printing object W to thereby print a color image on the printing object W. Specifically, in a case that the color image is to be printed on a fabric as the printing object W, the white ink is firstly discharged as a primer ink (base ink) in order to reduce any effect on the color of the fabric and the material of the fabric, and then the color ink(s) is (are) discharged onto the white ink. Note that the clear ink is discharged in a case of imparting luster (gloss) and/or in a case of protecting a printed part.

The platen 6 is configured so that the printing object W can be placed thereon. The platen 6 has a predetermined thickness, and is constructed of, for example, a rectangular shaped-plate member of which longitudinal direction is the sub scanning direction Df. The platen 6 is removably supported by a non-illustrated platen supporting stand. The above-described platen supporting stand is configured to be movable between a print position at which the printing with respect to the printing object W is executed, and a removal position at which the print matte W is removed from the platen 6. The print position is a position at which the platen 6 faces or is opposite to the discharging heads 10 and the removal position is a position at which the platen supporting stand is arranged at the outside of the casing 2 and at which the printing object W is placeable on the platen 6. At the time of the printing, since the platen 6 moves in the sub scanning direction Df, the printing object W placed on the platen 6 is conveyed in the sub scanning direction Df.

The upper cover 7 is configured so that in a case that a front part thereof is lifted, the front cover 7 is rotated upward, with a base end configured to be rotatable as the fulcrum. As a result, the interior (inner part) of the casing 2 is exposed.

Figure 3:
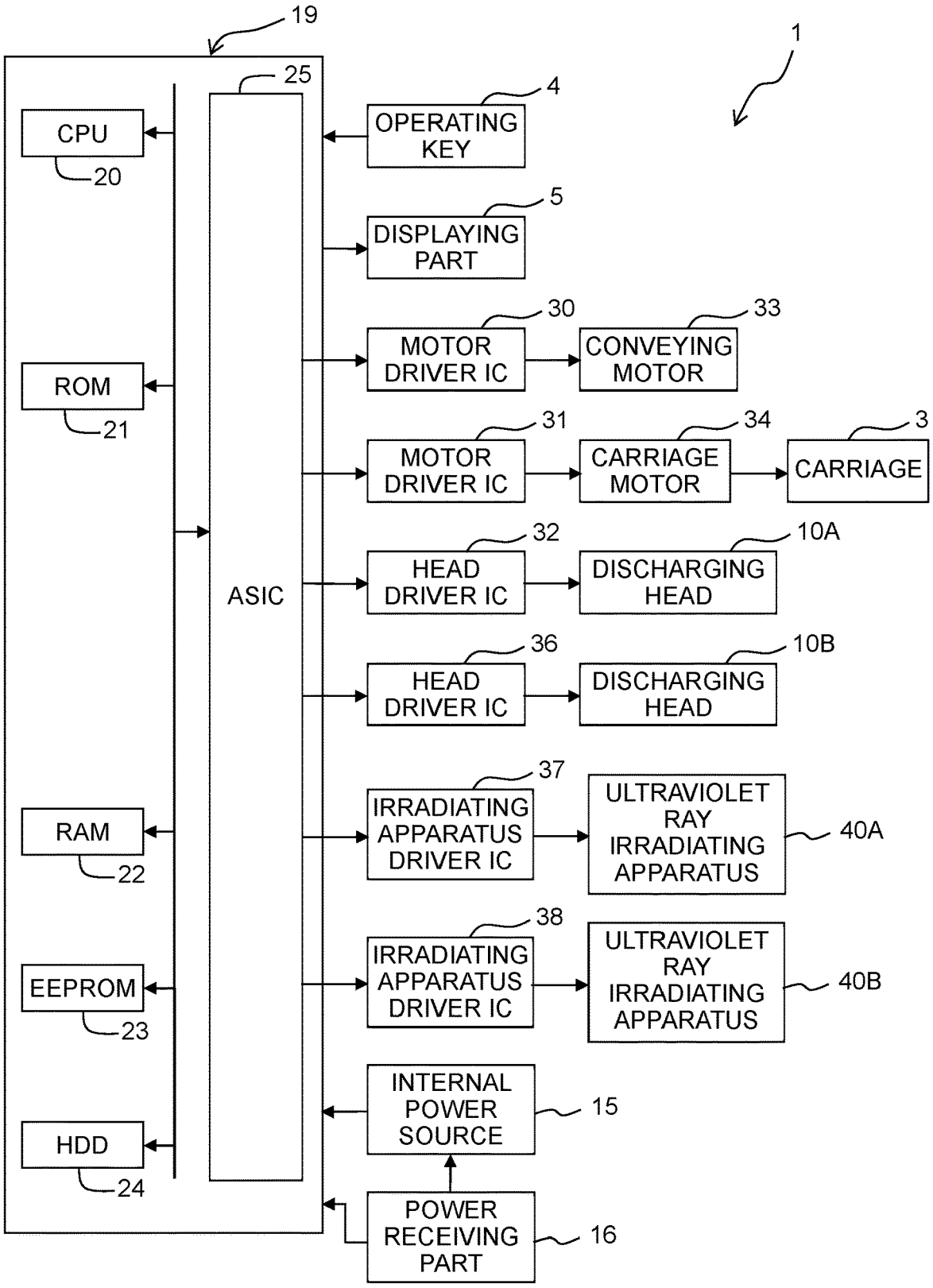
FIG. 3 is a block diagram depicting the configuration of the image recording apparatus of FIG. 1.

Next, the functions of respective configurations of the image recording apparatus 1 of the present embodiment will be explained, with reference to the block diagram of FIG. 3. As depicted in FIG. 3, the image recording apparatus 1 of the present embodiment includes motor driver ICs 30 and 31, head driver ICs 32 and 36, a conveying motor 33, a carriage motor 34, irradiating apparatus driver ICs 37 and 38, an internal power source 15, and a power receiving part 16, in addition to the constitutive elements described above. Note that the image recording apparatus 1 includes a non-illustrated ink tank configured to store the inks to be supplied to the discharging head(s) 10.

The controller 19 has a CPU 20, a memory (storage unit: a ROM 21, a RAM 22, a EEPROM 23, a HDD 24) and an ASIC 25. The CPU 20 is a controller of the image recording apparatus 1 and is connected to the memory (storage unit) and controls the respective driver ICs 30 to 32 and 36 to 38 and the displaying part 5.

The CPU 20 executes a variety of kinds of functions by executing a predetermined program stored in the ROM 21. The CPU 20 may be mounted as one processor in the controller 19 or as a plurality of processors cooperating with each other.

The ROM 21 stores a print controlling program with which the CPU 20 executes the printing processing. An arithmetic result of the CPU 20 is stored in the RAM 22. A variety of kinds of initial setting information inputted by the user is stored in the EEPROM 23. Specifying information, etc., is stored in the HDD 24. This specifying information is highly confidential information of which leakage is not preferred and includes, for example, information regarding the user, job data received by the image recording apparatus 1 from the outside and including an user ID specifying a source (sender), user usage history information including the user ID in the job data, secure job data including data regarding a password and a secure job, print history, cloud setting data, etc. The information regarding the user includes, for example, telephone directory information, E-mail address information, information regarding an administrator of the image recording apparatus 1 (security administrator), network setting information, etc. In a case that the image recording apparatus 1 receives the job data, the CPU 20 stores, in the HDD 24, the user usage history information including the user ID in the job data.

The motor driver ICs 30 and 31, the head driver ICs 32 and 36, and the irradiating apparatus driver ICs 37 and 38 are connected to the ASIC 25. In a case that the CPU 20 receives the print job from the user, the CPU 20 outputs print instruction to the ASIC 25 based on the print controlling program. The ASIC 25 drives the respective driver ICs 30 to 32 and 36 to 38 based on the print instruction. The CPU 20 moves the platen 6 in the sub scanning direction Df by driving the conveying motor 33 with the motor driver IC 30, thereby conveying the printing object W. The CPU 20 also drives the carriage motor 34 with the motor driver IC 31 to thereby move the carriage 3. Further, the CPU 20 discharges or ejects, with the head driver ICs 32 and 36, the ink(s) from the discharging head(s) 10 mounted on the carriage 3 which is being moved, and causes the image data to be printed on the printing object W which is being conveyed. Furthermore, the CPU 20 causes the ultraviolet ray irradiating apparatuses 40A and 40B, with the irradiating apparatus driver ICs 37 and 38, to irradiate the ultraviolet ray for curing the ink(s). The printing processing is performed by such a flow. The controller 19 controls the ultraviolet ray irradiating apparatuses 40A and 40B, and thus the controller 19 may be regarded as a part of the ultraviolet ray irradiating apparatus of the present embodiment.

Each of the controller 19, and the CPU 20 in the controller 19 is an example of the "controller".

The internal power source 15 is provided at a predetermined position in the casing 2. The internal power source 15 enables the controller 19 to be operable in a case that a power switch of a main body of the image recording apparatus 1 is in an OFF state. The internal power source 15 is, for example, a secondary cell (secondary battery). Further, the power receiving part 16 is provided so as to be exposed to the outside from the casing 2, and receives power supply from an external power source. In a case that the power switch of the main body is in an ON state, the power from the outside is supplied to each part of the image recording apparatus 1 via the power receiving part 16. The external power is supplied to the internal power source 15 via the power receiving part 16 regardless of the state of the power switch of the main body, and the internal power source 15 is charged by this power.

Next, an explanation will be given about an arrangement of the plurality of light emitting diode chips DT in the ultraviolet ray irradiating apparatus 40 of the present embodiment. In the present embodiment, each of the plurality of light emitting diode chips DT is a semiconductor element which generates the ultraviolet ray. Although the ultraviolet ray irradiating apparatus 40A and the discharging head 10A are representatively explained below, the ultraviolet ray irradiating apparatus 40B and the discharging head 10B can also be subjected to the configuration in the same manner as the ultraviolet ray irradiating apparatus 40A and the discharging head 10A.

Figure 4:
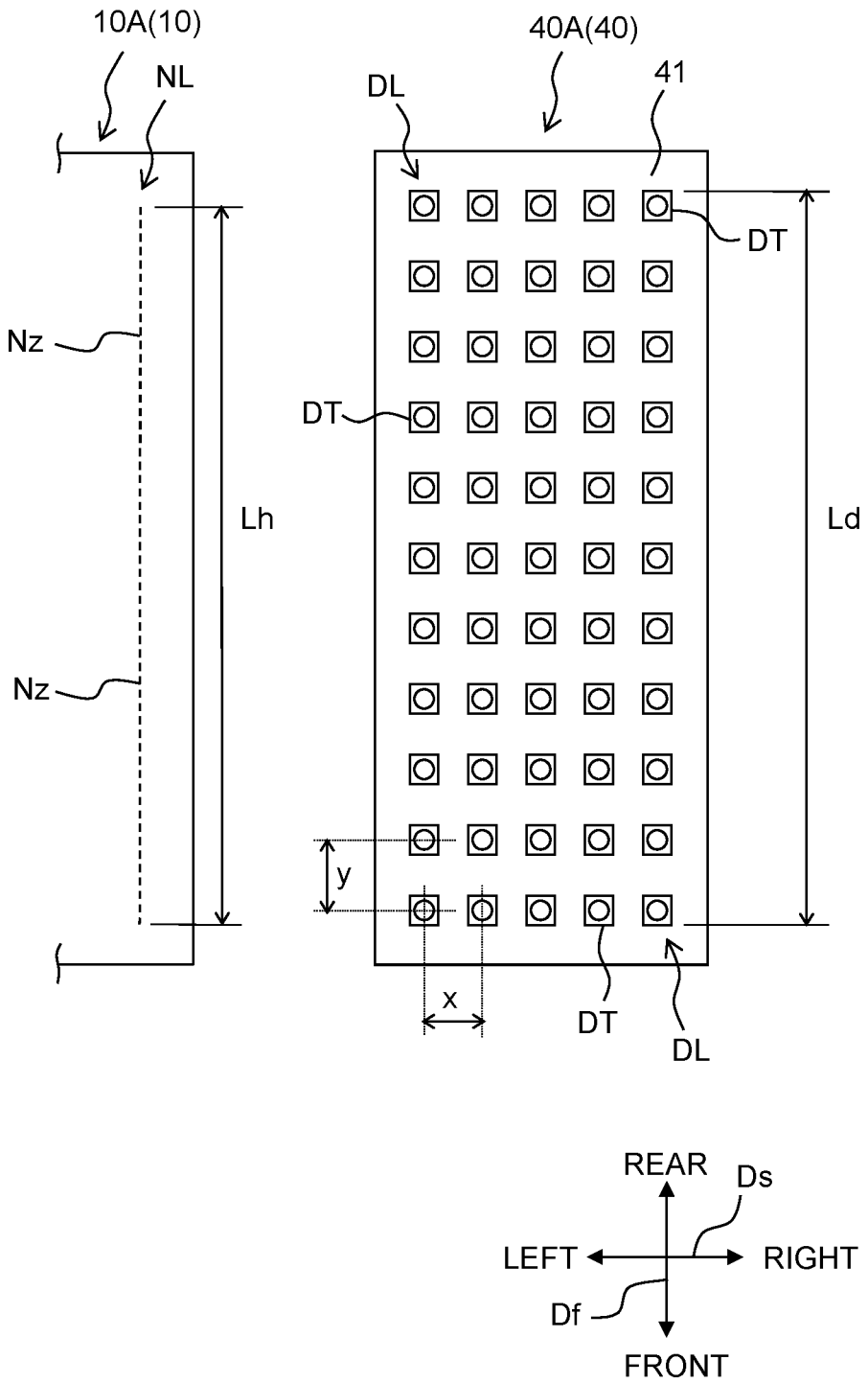
FIG. 4 is a bottom view depicting an example of arrangement of a nozzle array (nozzle column) in the discharging head of FIG. 1 and an example of arrangement of a plurality of light emitting diode chips in the ultraviolet ray irradiating apparatus.

As depicted in FIG. 4, the ultraviolet ray irradiating apparatus 40A includes a supporting substrate 41 formed, for example, in a rectangular shape in a plan view. The supporting substrate 41 is, for example, an aluminum substrate. The supporting substrate 41 may be formed of, for example, other metal such as copper, etc. Each of the plurality of light emitting diode chips DT is arranged on the supporting substrate 41.

Each of the plurality of light emitting diode chips DT irradiates the ink with the ultraviolet ray. With this, a photopolymerization initiating agent contained in the ink is caused to react, and to allow a monomer contained in the ink to polymerize, thereby fixing the ink to the printing object W. The plurality of light emitting diode chips DT is arranged in a matrix shape. The plurality of light emitting diode chips DT is arranged, for example, with a center of a unit lattice which is rectangular shaped and which has sides along the longitudinal direction and the short-length direction of the supporting substrate 41, as the reference. The plurality of light emitting diode chips DT is thereby arranged at a regular spacing distance along the main scanning direction Ds and at a regular spacing distance along the sub scanning direction Df. Thus, the plurality of light emitting diode chips DT is arranged along a row direction parallel to the main scanning direction Ds and along a column direction parallel to the sub scanning direction Df. FIG. 4 depicts an example wherein there are 11 (eleven) rows of the light emitting diode chip DT each of which is aligned in the left-right direction, and there are 5 (five) columns of the light emitting diode chip DT each of which is aligned in the front-rear direction. A group of light emitting diode chips DT, among the plurality of light emitting diode chips DT, which are aligned at a regular spacing distance therebetween along the sub scanning direction Df is defined as a chip column DL. Accordingly, FIG. 4 shows an example in which five chip columns DL are arranged. The number of the light emitting diode chip DT, the number of chip columns DL, and the number of chip rows arranged in the supporting substrate 41 are not limited to the above-described numbers, and are determined based on a cumulative irradiation light mount and/or power consumption in one pass, etc.

The discharging head 10A is provided with the four nozzle arrays NL as described above. Each of the nozzle arrays NL includes a plurality of nozzles Nz arranged side by side at a regular spacing distance along the sub scanning direction Df. The ink is discharged from the plurality of nozzles Nz. In each of the nozzle arrays NL, a distance from a nozzle Nz located at a front end of the sub scanning direction Df of the nozzle array NL to a nozzle Nz located at a rear end of the sub scanning direction Df of the nozzle array NL is defined as a nozzle length Lh. Note that FIG. 4 depicts only the nozzle array NL which discharges the ink of black (K), and that three other nozzle rows are omitted.

The respective light emitting diode chips DT of the ultraviolet ray irradiating apparatus 40A are arranged such that a light emitting area of the ultraviolet ray by the light emitting diode chips DT is greater in the sub scanning direction Df than the nozzle array NL. With this, in case that a length in the sub scanning direction Df of each of the chip columns DL, namely, a distance from a light emitting diode chip DT (a front end of the light emitting diode chip DT) located at a front end in the sub scanning direction Df to a light emitting diode chip DT (a rear end of the light emitting diode chip DT) positioned at a rear end in the sub scanning direction Df of each of the chip columns DL is made to be a light emitting length Ld, it is possible to make the light emitting length Ld to be greater than the nozzle length Lh. Therefore, the ultraviolet ray can be irradiated satisfactorily to an ink droplet discharged from the nozzle Nz located at the front end of the nozzle array NL and an ink droplet discharged from the nozzle Nz located at the rear end the nozzle array NL (nozzles Nz positioned outermost in the nozzle allay NL). In other words, in a state that the ultraviolet ray irradiating apparatuses 40 and the discharging heads 10 are mounted on the carriage 3, the nozzle allay NL and the chip column DL are parallel to each other, and the nozzle allay NL and the chip column DL are apart from each other in the main scanning direction Ds. In the sub scanning direction Df, the front end (one end) of the chip column DL is positioned front side of the front end (one end) of the nozzle array NL, and the rear end (the other end) of the chip column DL is positioned rear side of the rear end (the other end) of the nozzle array NL.

Figure 5:
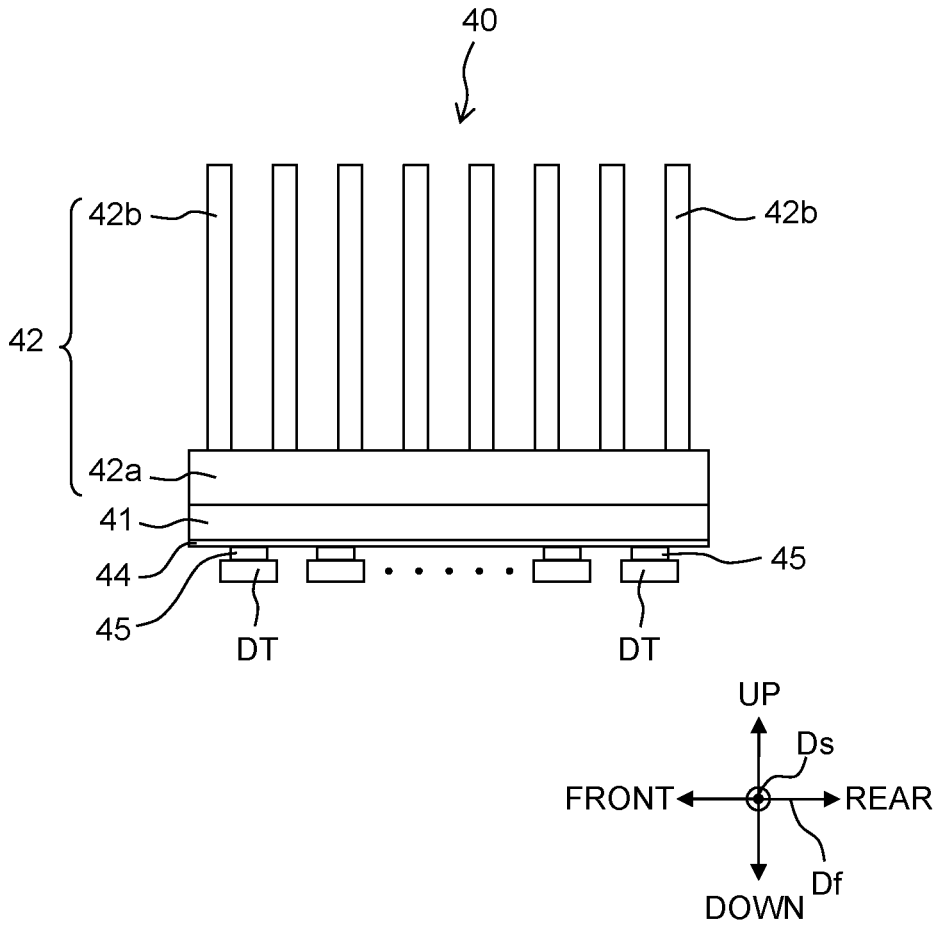
FIG. 5 is a view schematically depicting the internal configuration of the ultraviolet ray irradiating apparatus.

Here, a heat radiating structure of the ultraviolet ray irradiating apparatus 40 will be explained. As depicted in FIG. 5, the ultraviolet ray irradiating apparatus 40 includes the above-described supporting substrate 41 which supports the plurality of light emitting diode chips DT, and a plate-shaped heat sink 42 provided on a surface (upper surface) which is included in surfaces of the supporting substrate 41 and which is on the opposite side to another surface (lower surface) of the supporting substrate 41 provided with the plurality of light emitting diode chips DT. The heat sink 42 includes a base part 42*a* arranged on the supporting substrate 41 and a plurality of heat radiating plates (fins) 42*b* extending in an up direction on the base part 42*a*. The respective heat radiating plates 42*b* are arranged at an equal spacing distance. Further, non-illustrated electronic parts are provided on the lower surface of the supporting substrate 41, and a plurality of electrodes 45 are provided on these electronic parts corresponding to the plurality of light emitting diode chips DT, respectively. Each of the plurality of light emitting diode chips DT is electrically connected to one of the plurality of electrodes 45. In a state that a portion of each of the plurality of electrodes 45 is exposed, the lower surface of the supporting substrate 41 is covered with an insulative film 44. In such a configuration, a heat generated by each of the plurality of light emitting diode chips DT is radiated upward through heat sink 42.

Returning to FIG. 4, the respective light emitting diode chips DT are arranged side by side at a first pitch x in the main scanning direction Ds. Further, the respective light emitting diode chips DT are arranged side by side at a second pitch y in the sub scanning direction Df. The second pitch y is greater than the first pitch x. Specifically, the first pitch x and the second pitch y are determined so that $1.4x \leq y \leq 2.1x$ is satisfied or held. The wording of "pitch" means a distance between optical axes of the light emitting diode chips DT adjacent to each other. The first pitch x can be between 1 mm and 10 mm, can be between 2 mm and 7 mm, and can be between 4 mm and 6 mm.

Figure 6:
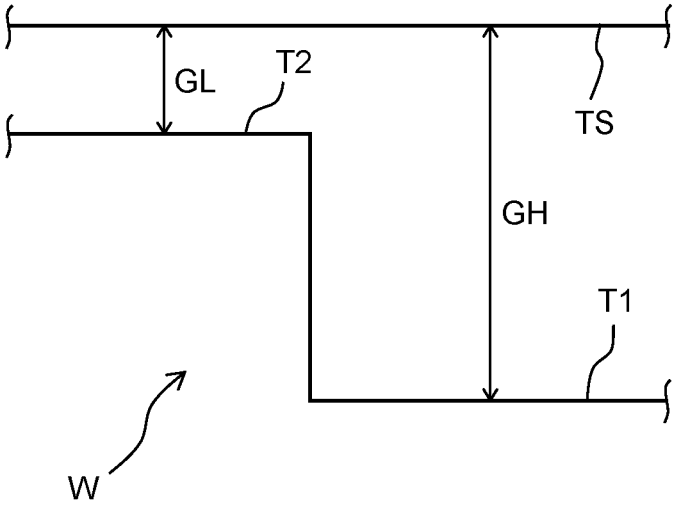
FIG. 6 is a view depicting a large gap and a small gap.

The image recording apparatus 1 of the present embodiment is capable of performing the printing in a small gap (low gap) and a large gap (high gap). A detailed explanation will be given as below. As depicted in FIG. 6, the printing object W include, for example, a low part T1 in which a distance from (with respect to) the ultraviolet ray irradiation surface TS of each of the plurality of light emitting diode chips DT becomes to be a large gap GH, and a high part T2 in which the distance with respect to the ultraviolet ray irradiation surface TS becomes to be a small gap GL smaller than the large gap GH. The large gap GH is, for example, 18 mm. The small gap GL is, for example, 2 mm. In the present embodiment, the second pitch y is adjusted so that a maximum illuminance at the high part T2, of the printing object W, which is apart (from the ultraviolet ray irradiation surface T) by 2 mm as the lower limit of the small gap GL, becomes to be not more than 4.5 W/cm$^2$. This lower limit (2 mm) of the small gap GL is a value to be set so that the printing object W and the discharging head 10 and/or the light emitting diode chip DT are not rubbed to each other, in consideration of any variation in assembly precision. Further, regarding the low part T1, of the printing object W, which is apart (from the ultraviolet ray irradiation surface T) by 18 mm as the upper limit of the large gap GH, an electric current value to be supplied to the light emitting diode chip DT is set so that the illuminance at a position or location, in the low part T1, corresponding to the end part of the nozzle array becomes to be 1.1 W/cm$^2$. This upper limit (18 mm) of the large gap GH is a value set as a distance by which any deviation in landing of the ink droplet falls within a predetermined range and by which a fine image may be printed.

In such a configuration, the maximum illuminance (a peak illuminance) of the ultraviolet ray by the plurality of light emitting diode chips DT obtained in one pass, of the discharging head 10, with respect to the high part T2 as a part of the printing object W in which the distance between the printing object W and the ultraviolet ray irradiation surface TS of the light emitting diode chips DT becomes to be the small gap GL, is not more than the maximum illuminance of the ultraviolet ray obtained in one pass in a case that the first pitch x and the second pitch y are the same (the conventional configuration. Note that the number of the light emitting diode chip DT, the number of chip columns DL, and the number of chip rows are identical to those of the present embodiment, respectively). Further, the illuminance of the ultraviolet ray by the plurality of light emitting diode chips DT, with respect to the low part T1 as a part of the printing object W in which the distance between the printing object W and the ultraviolet ray irradiation surface TS becomes to be the large gap GH, the illuminance being illuminance of the ultraviolet ray by the plurality of light emitting diode chips DT with respect to an area, of the low part T1, to which the ink is discharged by a nozzle Nz included in the plurality of nozzles Nz of the nozzle array NL and positioned at an end part (nozzle end) in the sub scanning direction Df, is not less than the minimum illuminance required for curing the discharged ink. Note that the phrase such as "for curing the ink", "the ink is cured", etc., indicates such a state that after completion of the print job, a print surface is rubbed by a fingertip, and that the fingertip is not dirtied and any fingerprint and/or rubbing trace (rubbing mark) is not left on the print surface (based on JIS K 5600-1-1 4.3.5 c).

In the printing operation, the controller 19 may control the irradiating apparatus driver IC 37, 38, for example, such that the illuminance of the ultraviolet ray emitted by the light emitting diode chips DT is set to be not less than a minimum illuminance, required for curing the ink on the low part T1 of the printing object W, in an area to which the ink droplet is discharged from the nozzle Nz positioned outermost in the nozzle allay NL. The area, of the low part T1, to which the ink droplet is discharged from the nozzle Nz positioned outermost in the nozzle allay NL may an area, of the low part T1, arranged so as to face the light emitting diode chip DT, of the plurality of light emitting diode chips DT, positioned outermost in the sub-scanning direction Df.

The controller 19 controls the illuminance of the ultraviolet ray emitted by the plurality of light emitting diode chips DT by, for example, changing magnitude of the supply current to each of the plurality of light emitting diode chips DT so as to change luminance of each of the plurality of light emitting diode chips DT. The magnitudes of the luminance of the plurality of light emitting diode chips DT may be identical to each other. The controller 19 may change the magnitudes of the luminance of the plurality of light emitting diode chips DT while maintaining a state in which the magnitudes of the luminance of the plurality of light emitting diode chips DT are identical to each other.

The controller 19 may obtain information (distance information DI) about a distance between the ultraviolet ray irradiation surface TS of the plurality of light emitting diode chips DT and the printing object W, and may control the illuminance of the ultraviolet ray emitted by the plurality of light emitting diode chips DT based on the distance information DI. The luminance of each of the plurality of light emitting diode chips DT required to realize the minimum illuminance (that is 1.1 W/cm$^2$ in this embodiment) required for curing the ink in the low part T1 of the printing object W can vary based on a size of the large gap GH. That is, the luminance of each of the plurality of light emitting diode chips DT required to realize the minimum illuminance required for curing the ink in the low part T1 of the printing object W increases as the size of the large gap increases. Therefore, for example, by controlling the luminance of each of the plurality of light emitting diode chips DT based on the distance between the ultraviolet ray irradiation surface TS of the plurality of light emitting diode chips DT and the printing object W, the irradiation of the ultraviolet ray can be performed more efficiently and the printing quality can be improved.

The controller 19 may obtain the distance information DI from an external apparatus as a part of the job data. In this case, the distance information DI may be created in the external apparatus (a PC, for example) by obtaining coordinates (position data, arrangement data) of a surface of the printing object W by, for example, any image processing software, a printer driver, etc.

Figure 10:
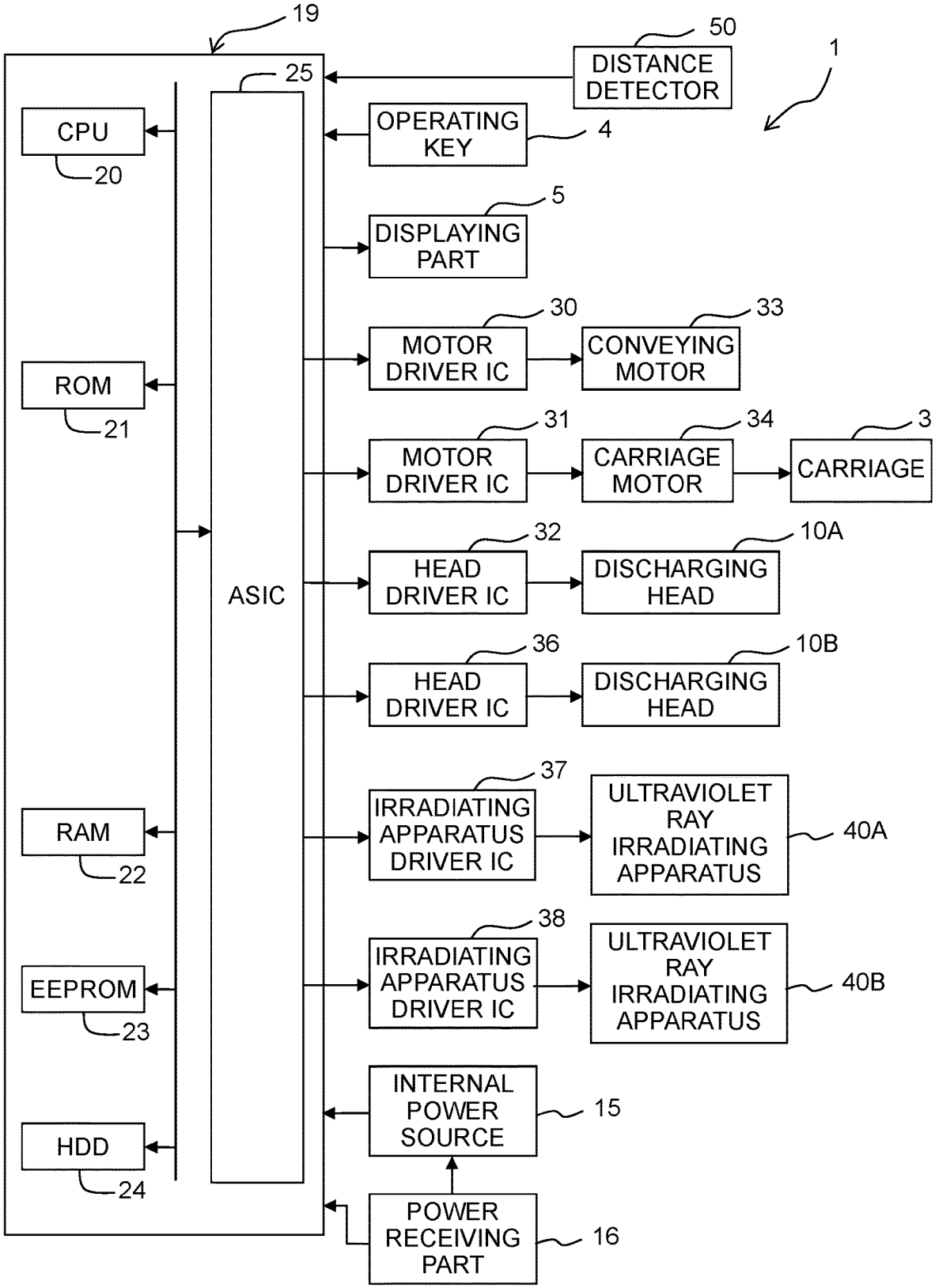
FIG. 10 is a block diagram depicting a configuration of an image recording apparatus of a modified embodiment.

As depicted in FIG. 10, the image recording apparatus 1 of the present embodiment may include a distance detector 50 which detects the distance between the ultraviolet ray irradiation surface TS of the plurality of light emitting diode chips DT and the printing object W. In this case, the controller 19 may create the distance information DI based on a value detected by the distance detector 50.

The distance detector 50 may be any device capable of detecting a distance, such as, for example, a camera (image sensor, stereo camera), an optical sensor, etc. The distance detector 50 may be provided on the lower surface of the carriage 3. The distance detector 50 may be regarded as a part of the ultraviolet ray irradiating apparatus of the present embodiment.

In the following, an explanation will be given about the reason for setting $1.4x \leq y \leq 2.1x$ in a case of determining the first pitch x and the second pitch y. In the case of determining such a ratio (y/x) of the second pitch y to the first pitch x, a viewpoint of securing sufficient ink curability (hereinafter referred to as the "first point of view") and a viewpoint of suppressing any thermal damage with respect to printing object W (hereinafter, referred to as the "second point of view") are considered.

In the first point of view, it is required to obtain an illuminance which is at least necessary for securing a sufficient ink curability (hereinafter referred to as the "minimum illuminance") in printing for the low part T1, of the printing object W, in which the distance between the printing object W and the ultraviolet ray irradiation surface TS of each of the plurality of light emitting diode chips DT becomes to be the large gap GH, by a configuration of arranging the respective light emitting diode chips DT at a maximum value of the first pitch x, among the values settable as the first pitch x. This requirement is based on a reason that an illuminance which is not less than the minimum illuminance can be obtained in a part, of the printing object W, which is subjected to the small gap printing (low gap printing), and in a part, of the printing object W, which is subjected to the large gap printing (high gap printing) by a configuration of arranging the respective light emitting diode chips DT at a first pitch x which is different from the first pitch x of the maximum value among the values settable as the first pitch x. The minimum illuminance in such a case is, for example, 1.1 W/cm$^2$. Further, although it is possible to obtain the illuminance of not less than the minimum illuminance more easily as the supply current to each of the plurality of light emitting diode chips DT is made to be greater, in reality, however, there is a restriction by the rating of the light emitting diode chip DT, and the maximum value of the current that can be inputted to the light emitting diode chip DT is, for example, 1 A (ampere) based on the rating.

Figure 7:
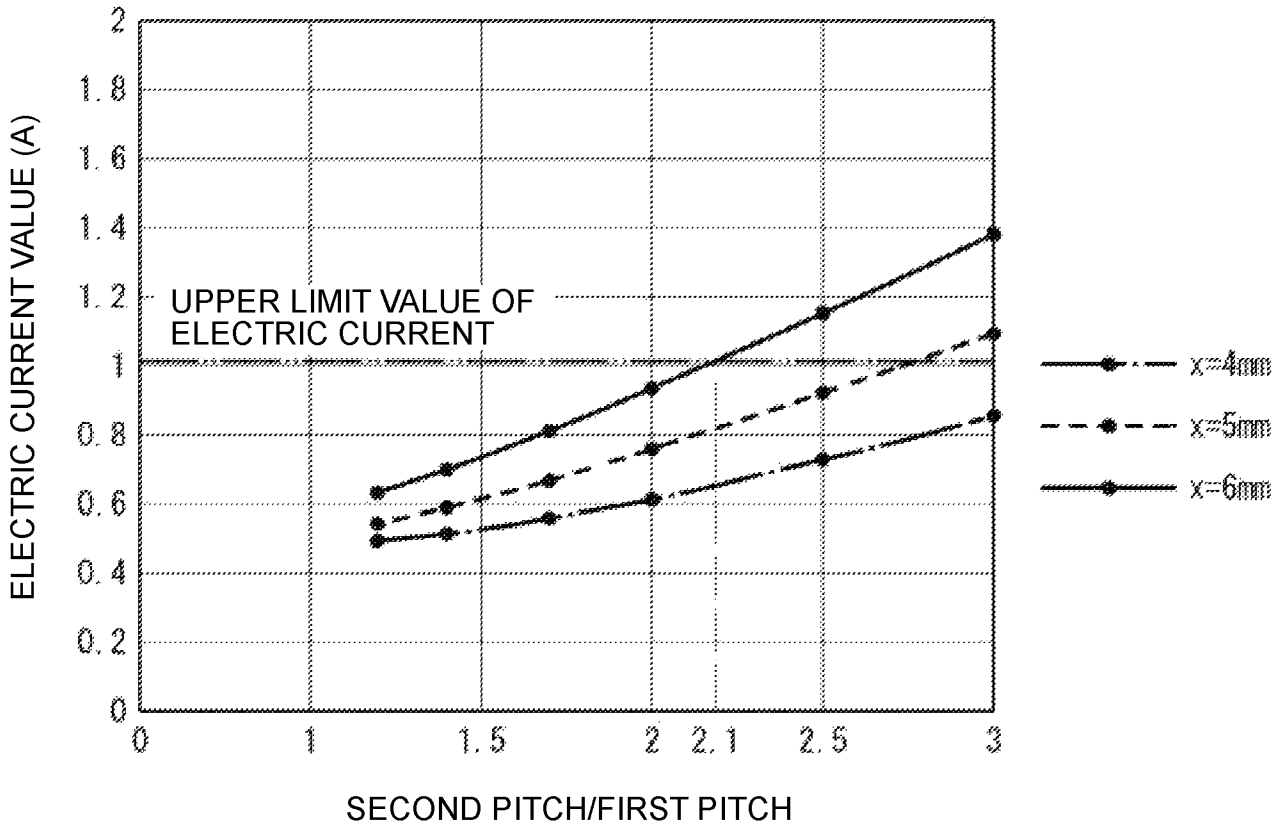
FIG. 7 is a graph depicting a relationship, obtained by a simulation, between a ratio of a second pitch to a first pitch, and a supply electric current value to the diode chip.

FIG. 7 is a graph indicating a relationship between the ratio of the second pitch y to the first pitch x and the supply electric current value to the light emitting diode chip DT. FIG. 7 indicates an electric current value (a supply electric current value to the light emitting diode chip DT) by which the minimum illuminance can be obtained in a case that the first pitch x is made to be a fixed value (x=4 mm, 5 mm, 6 mm in this example) and that the ratio of the second pitch y to the first pitch x is changed with respect to each of the above-described fixed values of the first pitch x.

Among the above-described three fixed values of the first pitch x, the maximum value is 6 mm, and since the electric current value (the maximum value) which can be inputted to the light emitting diode chip DT is 1 A as described above. Thus, y/x=2.1 can be obtained from FIG. 7. Therefore, if $y \leq 2.1x$ is satisfied as the upper limit of the second pitch y, the minimum illuminance can be obtained without allowing the supply current to the light emitting diode chip DT to exceed the rated current.

On the other hand, in the second point of view, with respect to a part, of the print mater W, which is to be subjected to the small gap printing by a configuration of arranging the respective light emitting diode chips DT at a minimum value of the first pitch x, among the values settable as the first pitch x, it requirement is required to make the illuminance of the light emitting diode chip DT to be not more than the maximum illuminance, the maximum illuminance being the illuminance of the light emitting diode chip DT for suppressing any thermal damage to the printing object W. This is based on a reason that the illuminance of the light emitting diode chips DT can be suppressed to be not more than the maximum illuminance in a part, of the printing object W, which is different from the part, of the print matte W, which is to be subjected to the small gap printing described above, namely, the part which is to be subjected to the large gap printing, and in a part, of the printing object W, which is to be subjected to the small gap printing by a configuration of arranging the respective light emitting diode chips DT at a first pitch which is different from the first pitch of the minimum value among the values settable as the first pitch x. The maximum illuminance in this case is, for example, 4.5 W/cm$^2$.

Figure 8:
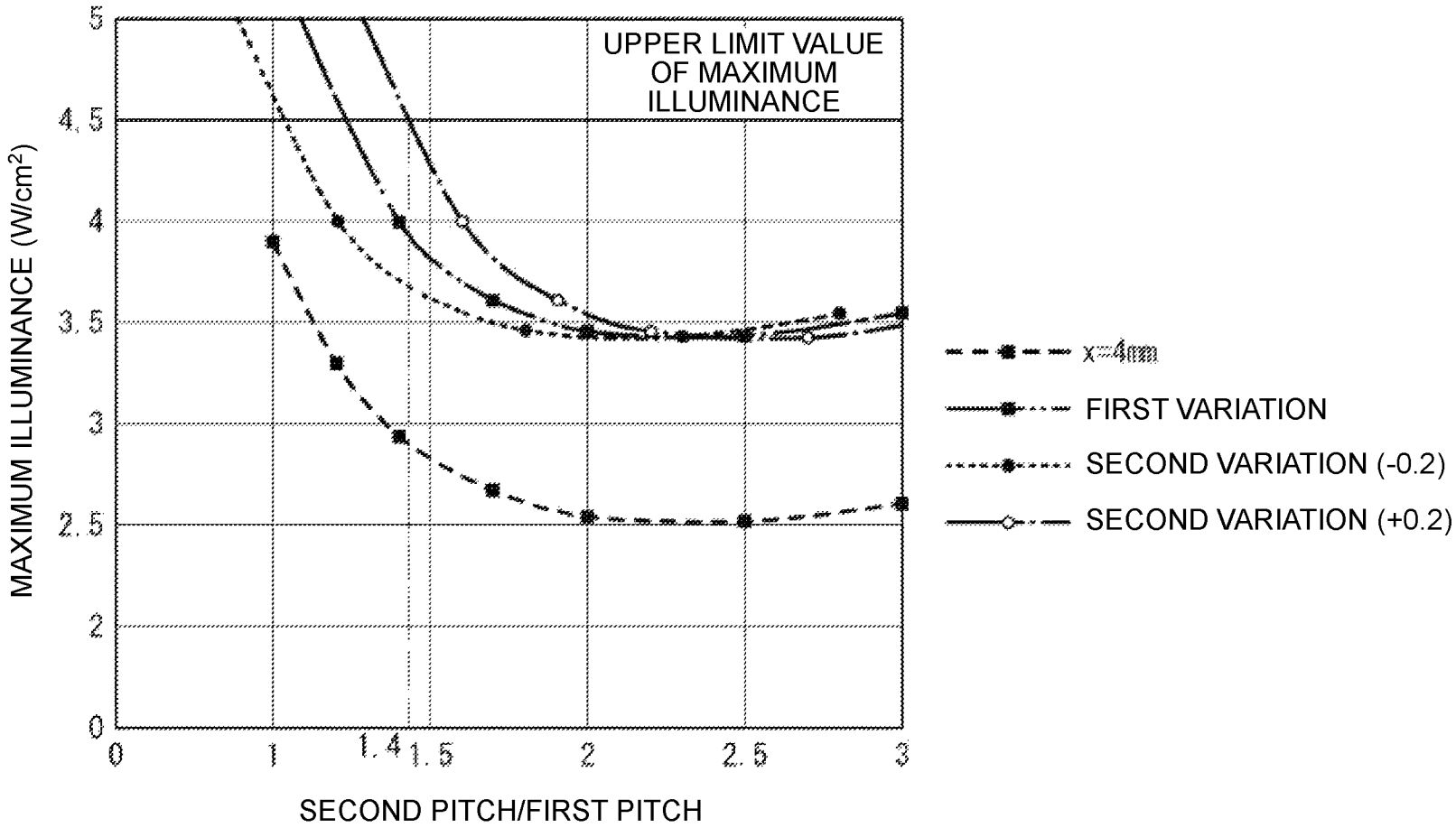
FIG. 8 is a graph depicting a relationship, obtained by a simulation, between the ratio of the second pitch to the first pitch, and a maximum illuminance.

FIG. 8 is a graph indicating a relationship between the ratio of the second pitch y to the first pitch x and the maximum illuminance of the light emitting diode chip DT. In FIG. 8, a curve indicated by a broken line represents a change in the maximum illuminance in a case that the ratio of the second pitch y to the first pitch x is changed, with the first pitch x being made to be a fixed value (x=4 mm in this example).

Here, there are (1) a case that the curve is varied (fluctuate) due to a variation in the individual performance among the light emitting diode chips DT and a variation in the assembly precision (assembly height precision) among the light emitting diode chips DT, and (2) a case that the curve is fluctuated due to a variation in the size among the supporting substrates 41 and a variation in assembly, with respect to the supporting substrate 41, among the light emitting diode chips DT. Therefore, the present embodiment considers the variations in Items (1) and (2) in finding the lower limit of the second pitch y. Specifically, in a case of considering the variation in Item (1) (the variation due to which the maximum illuminance becomes to be high), the relationship between the ratio of the second pitch y to the first pitch x and the maximum illuminance of the light emitting diode chip DT is consequently represented by a curve of two-dot-chain line in FIG. 8 (a curve of the first variation in FIG. 8). The maximum illuminance in this case increases by an extent of 1.1 W/cm$^2$, as compared to the maximum illuminance (broken line in FIG. 8) in a case that there is no variation.

Next, in a case of considering the variation in Item (2), the ratio y/x varies by an extent of ±0.2, with a curve of the two-dot chain line as a reference. In FIG. 8, the curve in a case that the ratio y/x varies by −0.2 is indicated as a curve of a dot line (a curve of a second variation (−0.2) in FIG. 8); the curve in a case that the ratio y/x varies by 0.2 is indicated, in FIG. 8, as a curve of a dash-dot line (a curve of a second variation (+0.2) in FIG. 8). In the second point of view of suppressing the thermal damage to the printing object W, it is allowable to obtain the ratio y/x in a case that the maximum illuminance becomes to be 4.5 W/cm$^2$ under a condition that the extent of the variation is +0.2, and thus the ratio y/x=1.4 can be obtained from FIG. 8. Therefore, as the lower limit of the second pitch y, provided that $1.4x \leq y$ holds, the thermal damage to the printing object W can be suppressed or prevented. Thus, the relationship of $1.4x \leq y \leq 2.1x$ can be obtained.

Figure 9:
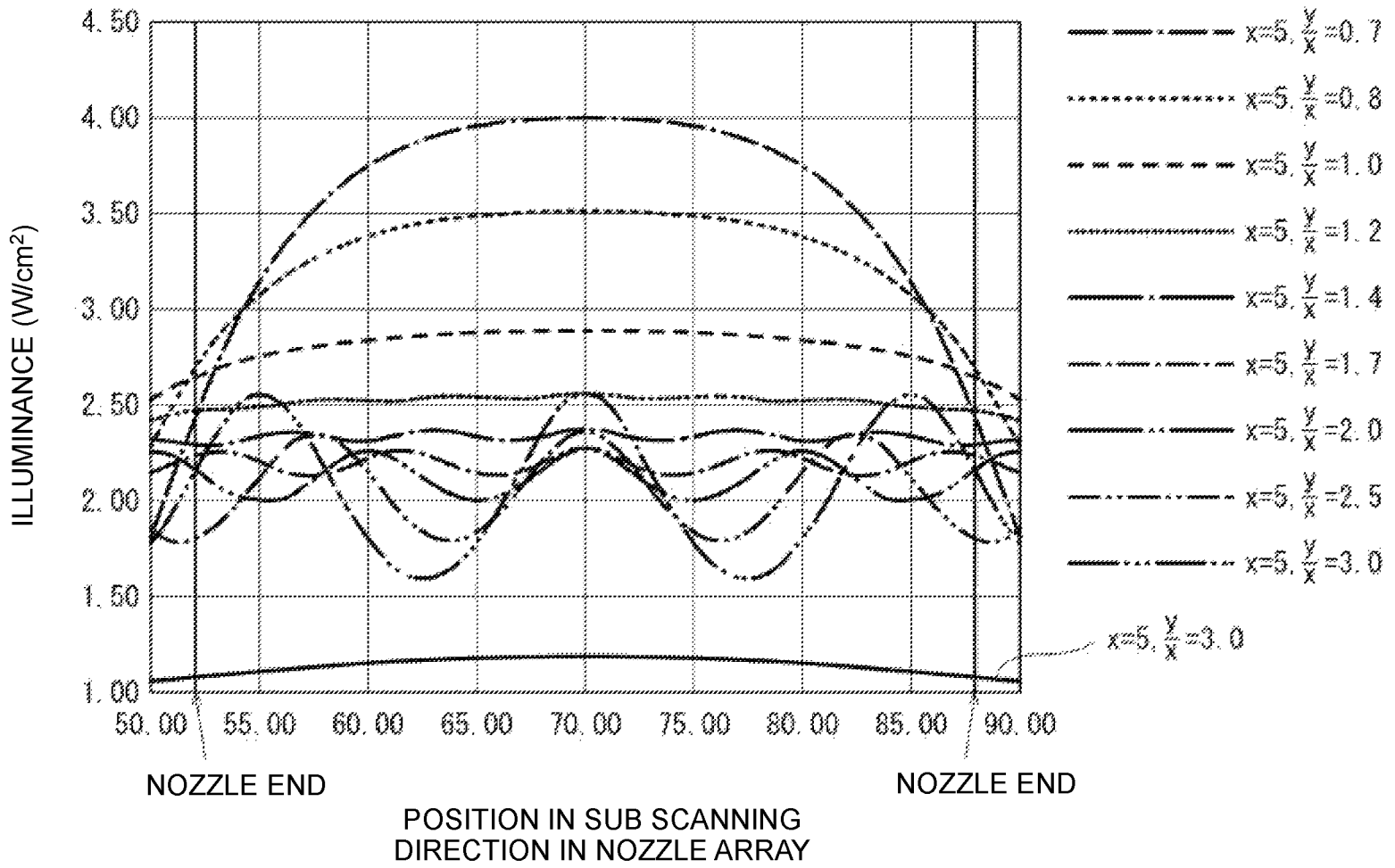
FIG. 9 is a graph depicting a relationship, obtained by a simulation, between a position in a sub scanning direction in the nozzle array and the illuminance.

Next, a relationship between a position in the sub scanning direction Df in the nozzle row Nz and the illuminance will be explained. FIG. 9 is a graph indicating a relationship between a position in the sub scanning direction Df in the nozzle row Nz and the illuminance, obtained by a simulation. FIG. 9 depicts the illuminance at a part, in the sub scanning direction Df, of the nozzle array NL subjected to the small gap printing, under a condition that the first pitch x is made to be a fixed value of x=5 mm, the ratio of the second pitch y to the first pitch x was provided as 9 (nine) kinds of ratio y/x=0.7, 0.8, 1.0, 1.2, 1.4, 1.7, 2.0, 2.5, and 3.0. Further, FIG. 9 indicates an illuminance at a part, in the sub scanning direction Df, of the nozzle row NL, which is subjected to the large gap printing with the first pitch is made to be the fixed value of x=5 mm and the ratio of the second pitch y to the first pitch x is made to be y/x=3.0 (see a solid line in FIG. 9). As depicted in FIG. 9, it is possible to confirm that the maximum illuminance can be suppressed to be not more than 4.5 W/cm$^2$ at the part subjected to the small gap printing, and that the illuminance of not less than 1.1 W/cm$^2$ can be obtained in the part subjected to large gap printing.

As described above, according to the ultraviolet ray irradiating apparatus 40 of the present embodiment, by making the second pitch y to be greater than the first pitch x, it is possible to suppress the temperature rise in the printing object W at the part thereof subjected to the small gap printing without unnecessarily lowering the maximum illuminance. Further, by making the illuminance of the ultraviolet ray at an end area in the sub scanning direction Df of the part subjected to large gap printing to be not less than the minimum illuminance required for the ink to cure, it is possible to suppress the unevenness in curing of the ink in the part subjected to large gap printing, thereby making it possible to improve the ink curability.

Namely, in the present embodiment, the controller 19 sets the illuminance in the sub scanning direction Df, in which any unevenness in the illuminance may be generated, such that the illuminance at the end area in the sub scanning direction Df of the low part T1 in the printing object W (namely, the illuminance at the area in which the ultraviolet ray delivered thereto from the ultraviolet ray irradiation surface TS is the smallest), is not less than the minimum illuminance required for curing the ink, thereby securing that the ink discharged or ejected onto the printing object W is cured satisfactorily. Meanwhile, the period in the sub scanning direction Df of the light emitting diode chip DT is made large, to suppress any increase in the illuminance (in particular, any increase in the illuminance with respect to the high part T2) accompanying with the illuminance in the sub scanning direction Df at the end area in the sub scanning direction Df of the low part T1 in the printing object W being made to be not less than the minimum illuminance required for curing the ink.

Further, in the present embodiment, since the minimum illuminance is 1.1 W/cm$^2$, the ink curability can be ensured sufficiently even in the part subjected to large gap printing.

Furthermore, in the present embodiment, the maximum illuminance of the ultraviolet ray by the plurality of light emitting diode chips DT obtained in one pass of the discharging head 10 in the part subjected to the small gap printing is not more than the maximum illuminance of the ultraviolet ray obtained in one pass in a case that the first pitch x and the second pitch y are the same. Therefore, it is possible to suppress or prevent the thermal damage in the part subjected to the small gap printing.

Moreover, in the present embodiment, since the maximum illuminance in the part subjected to the small gap printing (the high part T2) is not more than 4.5 W/cm$^2$, it is possible to suppress or prevent any thermal damage to the high part T2.

Further, in the present embodiment, even in a part subjected to the large gap printing in a state that the large gap GH is not less than 7 mm, the illuminance of the ultraviolet ray in the end area in the sub scanning direction Df can be made to be not less than the minimum illuminance required for the ink to cure. This makes it possible to suppress the unevenness in curing of the ink and consequently to improve the ink curability.

Furthermore, in the present embodiment, it is possible to make the illuminance of the ultraviolet ray in the end area in the sub scanning direction Df to be not less than the minimum illuminance required for the ink to cure, even in the part subjected to the large gap printing in the state that the difference between the large gap GH and the small gap GL is not less than 5 mm. This makes it possible to suppress the unevenness in curing of the ink and consequently to improve the ink curability.

Moreover, in the present embodiment, the electric current value to be supplied to the light emitting diode chip DT is set so that, regarding the part, of the printing object W, subjected to large gap printing in a state that the large gap GH is not more than 18 mm, the illuminance at a position of the part corresponding to the end part of the nozzle array becomes to be 1.1 W/cm$^2$. This makes it possible to improve the curability of the ink discharged to the part corresponding to the end part of the nozzle array.

Further, in the present embodiment, it is possible to suppress the temperature rise in the printing object W, without increasing the maximum illuminance more than as being required, even in the part subjected to the small gap printing in a state that the small gap GH is not less than 2 mm.

Furthermore, in the present embodiment, since $1.4x \leq y$ is satisfied in the relationship between the first pitch x and the second pitch y, it is possible to suppress or prevent the thermal damage to the part, of the printing object W, subjected to the small gap printing.

Moreover, in the present embodiment, since $y \leq 2.1x$ is satisfied in the relationship between the first pitch x and the second pitch y, the minimum illuminance required for the ink curing can be obtained without making the supply current to the light emitting diode chip DT to exceed the rated current.

Further, in the present embodiment, since the first pitch x is not less than 4 mm, it is possible to reliably suppress or prevent thermal effect to the printing object W.

Furthermore, in the present embodiment, since the ultraviolet ray irradiating apparatus 40 is provided with heat sink 42, it is possible to dissipate or radiate the heat generated by each of the plurality of light emitting diode chips DT upward through heat sink 42.

Moreover, by providing the above-described ultraviolet ray irradiating apparatus 40 on the image recording apparatus 1, it is possible to improve the ink curability by suppressing the unevenness in curing of the ink in the part subjected to large gap printing in the image recording apparatus 1, and it is possible to suppress the temperature rise in the printing object W at the part thereof subjected to the small gap printing in the image recording apparatus 1.

<Modifications>

The present invention is not limited to the above-described embodiment, and various change or modifications are possible within a range not deviating from the gist of the present invention. The following is examples of modification.

In the above-described embodiment, although $y \leq 2.1x$ is made to held in the case of determining the first pitch x and the second pitch y, the present invention is not limited to this; it is allowable to make, for example, $y \leq 2.0x$ to be held for a further improvement of the ink curability.

Further, in the above-described embodiment, although $1.4x \leq y$ is made to be held or satisfied in the case of determining the first pitch x and the second pitch y, the present disclosure is not limited to this; it is allowable to determine the value of y/x in accordance with the magnitudes of the above-described first variation and second variation. In such a case that the first variation and the second variation become to be great, it is allowable to make, for example, $1.5x \leq y$ to be held.

Furthermore, in the above-described embodiment, although the large gap GH is made to be 18 mm and the small gap GL is made to be 2 mm, the large gap GH and the small gap GL are not limited to the above-described values, respectively; it is sufficient if the small gap GL is smaller than the large gap GH. For example, the large gap GH is not less than 7 mm and the difference between the large gap GH and the small gap GL is not less than 5 mm.

Moreover, in the above-described embodiment, although the two discharging heads 10 (10A, 10B) and the two ultraviolet ray irradiating apparatuses 40 (40A, 40B) are mounted on the carriage 3, the present invention is not limited to this; it is allowable that only the discharging head 10A and only the ultraviolet ray irradiating apparatus 40A are mounted on the carriage 3.

According to the above embodiments, it is possible to provide: an ultraviolet ray irradiating apparatus capable of suppressing the temperature rise in the part, of the printing object, which is subjected to the small gap printing and improving the ink curability in the part, of the printing object, which is subjected to large gap printing; and an image recording apparatus provided with the same.

What is claimed is:

1. An ultraviolet ray irradiating apparatus configured to cure an ultraviolet-curable ink discharged to an object, by a discharging head which has a plurality of nozzles and which is configured to move in a main scanning direction, in a state that the ultraviolet ray irradiating apparatus is moved in the main scanning direction, the ultraviolet ray irradiating apparatus comprising a plurality of light emitting chips configured to emit an ultraviolet ray, the plurality of light emitting chips being arranged side by side with a first pitch in the main scanning direction and being arranged side by side with a second pitch greater than the first pitch in a sub scanning direction orthogonal to the main scanning direction, wherein the object includes a low part in which a distance from an ultraviolet ray irradiation surface of each of the plurality of light emitting chips to the object becomes to be a large gap and a high part in which the distance from the ultraviolet ray irradiation surface to the object becomes to be a small gap smaller than the large gap; and the ultraviolet ray irradiating apparatus is configured to irradiate the object with the ultraviolet ray such that an illuminance, of the ultraviolet ray emitted by the plurality of light emitting chips, is not less than a minimum illuminance required for curing the discharged ink, in an area, of the low part, onto which the ink is discharged by a nozzle, of the plurality of nozzles, positioned outermost in the sub scanning direction.

2. The ultraviolet ray irradiating apparatus according to claim 1 further comprising a controller configured to control the plurality of light emitting chips such that the illuminance, of the ultraviolet ray emitted by the plurality of light emitting chips, is not less than the minimum illuminance, in the area, of the low part, onto which the ink is discharged by the nozzle positioned outermost in the sub scanning direction.

3. The ultraviolet ray irradiating apparatus according to claim 2, wherein the controller is configured to control the plurality of light emitting chips based on information about the distance from the ultraviolet ray irradiation surface to the object such that the illuminance is not less than the minimum illuminance, in the area, of the low part, onto which the ink is discharged by the nozzle positioned outermost in the sub scanning direction.

4. The ultraviolet ray irradiating apparatus according to claim 3 further comprising a distance detector configured to detect the distance from the ultraviolet ray irradiation surface to the object, wherein the controller is configured control the plurality of light emitting chips based on the distance detected by the distance detector such that the illuminance is not less than the minimum illuminance in the area, of the low part, onto which the ink is discharged by the nozzle positioned outermost in the sub scanning direction.

5. The ultraviolet ray irradiating apparatus according to claim 1, wherein the ultraviolet ray irradiating apparatus is configured to irradiate the object with the ultraviolet ray such that the illuminance, of the ultraviolet ray emitted by the plurality of light emitting chips, is not less than the minimum illuminance in the area, of the low part, onto which the ink is discharged by the nozzle positioned outermost in the sub scanning direction, in a state that magnitudes of luminance of the respective light emitting chips are identical to each other.

6. The ultraviolet ray irradiating apparatus according to claim 1, wherein the minimum illuminance is 1.1 $W/cm^2$.

7. The ultraviolet ray irradiating apparatus according to claim 1, wherein in the high part, a maximum illuminance of the ultraviolet ray emitted by the plurality of light emitting chips is not more than a maximum illuminance of an ultraviolet ray emitted by a plurality of light emitting chips arranged such that the first pitch and the second pitch are same.

8. The ultraviolet ray irradiating apparatus according to claim 1, wherein a maximum illuminance in the high part is not more than 4.5 $W/cm^2$.

9. The ultraviolet ray irradiating apparatus according to claim 1, wherein the large gap is not less than 7 mm.

10. The ultraviolet ray irradiating apparatus according to claim 1, wherein a difference between the large gap and the small gap is not less than 5 mm.

11. The ultraviolet ray irradiating apparatus according to claim 1, wherein the large gap is not more than 18 mm.

12. The ultraviolet ray irradiating apparatus according to claim 1, wherein the small gap is not less than 2 mm.

13. The ultraviolet ray irradiating apparatus according to claim 1, wherein $1.4x \leq y$ holds, provided that x is the first pitch and y is the second pitch.

14. The ultraviolet ray irradiating apparatus according to claim 1, wherein $y \leq 2.1x$ holds, provided that x is the first pitch and y is the second pitch.

15. The ultraviolet ray irradiating apparatus according to claim 1, wherein $1.4x \leq y \leq 2.1x$ holds, provided that x is the first pitch and y is the second pitch.

16. The ultraviolet ray irradiating apparatus according to claim 1, wherein the first pitch is not less than 4 mm.

17. The ultraviolet ray irradiating apparatus according to claim 1, further comprising:

a supporting substrate configured to support the plurality of light emitting chips; and a heatsink which is provided on a surface included in surfaces of the supporting substrate and located on an opposite side to another surface having the plurality of light emitting chips, the heatsink having a plurality of fins which extend in a direction orthogonal to the surface of the supporting substrate.

18. An image recording apparatus comprising a carriage provided with the ultraviolet ray irradiating as defined in claim 1, and the discharging head.

19. An ultraviolet ray irradiating apparatus configured to cure an ultraviolet-curable ink discharged to an object, by a discharging head which has a plurality of nozzles and which is configured to move in a main scanning direction, in a state that the ultraviolet ray irradiating apparatus is moved in the main scanning direction, the ultraviolet ray irradiating apparatus comprising a plurality of light emitting chips configured to emit an ultraviolet ray, the plurality of light emitting chips being arranged side by side with a first pitch in the main scanning direction and being arranged side by side with a second pitch greater than the first pitch in a sub scanning direction orthogonal to the main scanning direction, wherein the object includes a low part in which a distance from an ultraviolet ray irradiation surface of each of the plurality of light emitting chips to the object becomes to be a large gap and a high part in which the distance from the ultraviolet ray irradiation surface to the object becomes to be a small gap smaller than the large gap; and the ultraviolet ray irradiating apparatus is configured to irradiate the object with the ultraviolet ray such that an illuminance, of the ultraviolet ray emitted by the plurality of light emitting chips is not less than a minimum illuminance required for curing the discharged ink, in an area, of the low part, arranged so as to face an outermost light emitting chip, of the plurality of light emitting chips, positioned outermost in the sub-scanning direction.

* * * * *